United States Patent [19]

Green et al.

[11] 4,032,842

[45] June 28, 1977

[54] SPARK PLUG TESTER IGNITION SYSTEM

[75] Inventors: Sam J. Green, Temperance, Mich.; Richard E. Callahan, Toledo, Ohio

[73] Assignee: Champion Spark Plug Company, Toledo, Ohio

[22] Filed: Jan. 28, 1976

[21] Appl. No.: 653,092

[52] U.S. Cl. ..... 324/15; 323/18

[51] Int. Cl.[2] ..... F02P 17/00

[58] Field of Search ..... 324/15, 17; 323/4, 6, 323/18

[56] References Cited

UNITED STATES PATENTS

| | | | |
|---|---|---|---|
| 1,695,557 | 12/1928 | Myers | 324/15 |
| 2,603,685 | 7/1952 | Bychinsky | 324/15 |
| 3,360,718 | 12/1967 | Williams | 324/15 |

*Primary Examiner*—Stanley T. Krawczewicz
*Attorney, Agent, or Firm*—Oliver E. Todd, Jr.

[57] ABSTRACT

An improved high voltage pulse power supply for a spark plug test fixture. AC line voltage is applied through a voltage step-down transformer, a half wave rectifier and an electronic switch to the primary winding of a conventional ignition coil. During the rise time of positive half cycles, the rectified voltage is applied through the electronic switch to the ignition coil primary. As the positive half cycle begins to fall towards the zero crossover, the electronic switch is opened. The magnetic field collapse in the ignition coil produces a high voltage negative pulse which is applied to a spark plug under test. The peak voltage of the negative pulse is adjusted by controlling the peak current in the ignition coil primary.

10 Claims, 3 Drawing Figures

SPARK PLUG TESTER IGNITION SYSTEM

BACKGROUND OF THE INVENTION

This invention relates to internal combustion engine ignition system testing and more particularly to an improved high voltage power supply for a spark plug test fixture.

Service facilities for internal combustion engines such as those used in automobile, aircraft and the like, generally have test fixtures for testing the operation of spark plugs. Such fixtures test spark plugs by applying a high voltage across the spark gap in the plug while the gap is subjected to high pressure. The high pressure is applied from a source of compressed air such as the standard air compressor found in most service facilities while the high voltage is applied from a power supply located within the test fixture. The "quench pressure" of a spark plug under test is measured by increasing the air pressure at the spark gap until the plug ceases to fire. If such spark plug is not capable of sparking or firing while subjected to a predetermined air pressure and a predetermined high voltage, the plug is discarded.

Various types of power supplies have commonly been used in the past for generating high voltages in spark plug test fixtures. One commonly used power supply involves the use of a vibrator and an ignition coil. A DC power source, such as a battery or rectified alternating current is applied to the vibrator which in turn drives the primary winding of the ignition coil. However, the vibrator causes the ignition coil to have a fluctuating peak output voltage which causes a very broad indication of the quench pressure for the spark plug. In addition to obtaining only a broad indication of the quench pressure for the spark plug, the vibrating contacts in the vibrator also produce a large amount of electomagnetic interference. In a second type of high voltage power supply, a DC power source is connected to charge a capacitor. When the charge on the capacitor exceeds the breakdown voltage of a breakdown device such as a neon filled discharge tube, the capacitor is discharged through the device to the primary winding of an ignition coil. The resulting high secondary voltage is applied to the spark plug under test. Both types of power supplies provide only a general indication of the quench pressure for a spark plug under test. One source of difficulty is in the wide variations or fluctuations in the peak output voltage applied to the spark plug during test. Still another difficulty with prior art high voltage power supplies for spark plug test fixtures is the inability or difficulty to adjust the peak output voltage. Since different types of spark plugs, such as aircraft and automotive spark plugs, are tested at different voltages, different power supplies have normally been necessary for testing different types of spark plugs.

SUMMARY OF THE INVENTION

According to the present invention, an improved high voltage pulse power supply applies uniform high voltage pulses to a spark plug in a test fixture. The voltage pulses are adjustable in magnitude and closely simulate the pulses applied to the spark plug during operation in an internal combustion engine. The pulses are generated by periodically opening the primary circuit to an ignition coil with an electronic switch which simulates the interruption of the current to the primary winding of an ignition coil in an engine ignition system by the opening of breaker points.

The power supply includes a voltage step-down transformer which is connected through a momentary contact push button switch to a commercial line voltage source of alternating current. The step-down transformer preferably has a 12-volt output which is applied through a half wave rectifier and an electronic switch to the primary winding of a conventional 12-volt ignition coil. During the rise time of positive half cycles, the rectified output from the transformer is applied through the electronic switch to the primary winding of the ignition coil for establishing a magnetic field in the coil core. Either the conduction of the electronic switch of the resistance of the ignition coil primary circuit is controlled to adjust the peak output voltage applied to the spark plug. When the positive half cycle has reached its maximum voltage and begins to fall, the electronic switch is shut off to open the primary circuit to the ignition coil. The resulting collapse in the magnetic field in the core of the ignition coil establishes a high negative secondary voltage which is applied to the spark plug under test. At the same time, the spark plug is subjected to a high air pressure. The pressure is varied to determine the pressure at which the spark plug first fails to spark. If the spark plug fails to spark when the high voltage pulse and a predetermined high air pressure are applied to the spark gap on the plug, the plug is discarded. Since the improved power supply includes an electonic switch and has no moving parts such as vibrator contacts, electromagnetic interference is not generated as in prior art spark plug test fixture power supplies. Furthermore, by providing control over the peak voltage of the pulses applied to the spark plug, the power supply may be used in fixtures for testing various types of spark plugs.

Accordingly, it is an object of the invention to provide an improved high voltage power supply for a spark plug test fixture.

Another object of the invention is to provide an improved power supply for a spark plug test fixture which generates high voltage pulses similar to those applied to the spark plug during operation in an internal combustion engine.

Still another object of the invention is to provide a high voltage power supply for a spark plug test fixture in which the voltage is adjustable for testing different types of spark plugs.

Other objects and advantages of the invention will become apparent from the following detailed description, with reference being made to the accompanying drawings.

DESCRIPTION OF THE PREFERRED EMBODIMENT

Figure 1:
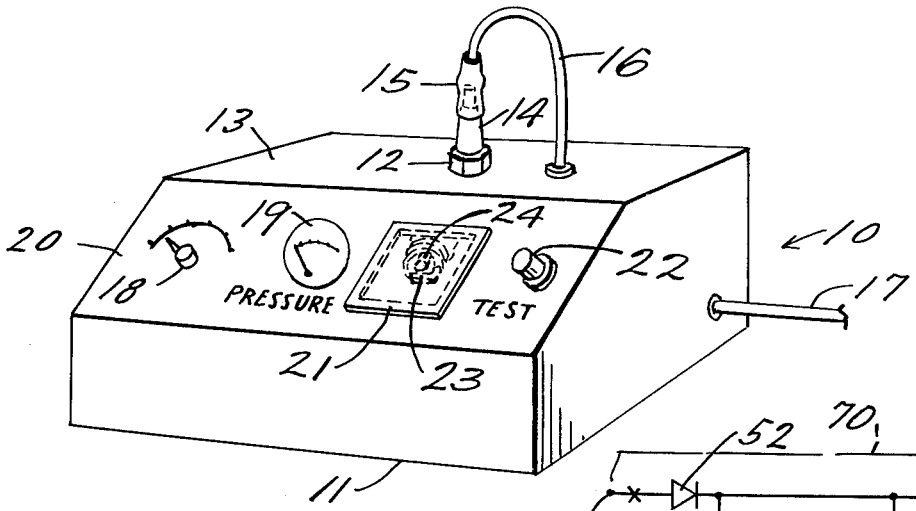
FIG. 1 is a perspective view of a typical spark plug test fixture in which the power supply of the present invention may be used.

Referring now to the drawings and particularly to FIG. 1, an exemplary spark plug test fixture 10 is shown. The fixture 10 includes a housing 11 having a threaded socket 12 in its upper surface 13 for receiving a spark plug 14. During testing, the spark plug 14 is screwed into the socket 12 and a boot 15 on the end of a high voltage ignition cable 16 is placed over the spark plug 14 to connect the cable 16 to the center electrode in the spark plug 14. A line 17 connected to a source of compressed air, such as a standard air compressor found in automotive service stations, is connected to the fixture 10. The line 17 is connected through a valve 18 to apply controlled air pressure to the firing end of the spark plug 14. The actual air pressure applied to the spark plug 14 is determined by the setting of the valve 18 and is indicated on a pressure gauge 19 on a front panel 20 of the housing 11. The front panel 20 also includes a viewing port 21 which permits viewing the spark gap of the spark plug 14 through an internal mirror arrangement located within the housing 11. In addition, a momentary contact push button switch 22 is located on the panel 20 for energizing a high voltage power supply within the housing 11. When energized, the power supply applies high voltage pulses to the cable 16. If the spark plug 14 is sparking, the operator will view through the port 21 a spark between a ground electrode 23 and a center electrode 24 of the spark plug 14. If the quench pressure for the spark plug 14 is exceeded, the high voltage will not jump between the ground electrode 23 and the center electrode 24 when the test switch 22 is actuated.

The actual voltage applied to the spark plug 14 during test, as well as pressure set by the valve 18, depends upon the type and intended use for such spark plug 14. For example, a voltage on the order of 17 kilovolts may be sufficient for testing a spark plug 14 for automotive use, while a voltage on the order of 21 kilovolts may be required for testing a spark plug 14 for aircraft use. In operation, the spark plug 14 is attached to the socket 12 in the fixture housing 11 and the boot 15 is placed over the spark plug 14. The operator then presses the test button and gradually opens the valve 18 until the spark plug 14 ceases to fire, as viewed through the port 21. At this point, the operator compares the pressure indicated on the gauge 19 with a chart. The maximum pressure at which a good spark plug 14 will continue to spark is determined by the size of the gap between the ground electrode 23 and the center electrode 21. For example, it may be determined that a good automotive spark plug having a gap of 0.025 inch will continue to spark up to a pressure of 100 psig, a good spark plug having a gap of 0.030 inch will continue to spark up to a maximum pressure of 80 psig, a good spark plug having a gap of 0.035 inch will continue to spark up to a pressure of 70 psig, etc. If for any given gap size, the spark plug continues to fire above these pressures, the plug is determined to be good. On the other hand, if the spark plug 14 does not fire at these pressures, it is discarded.

Figure 2:
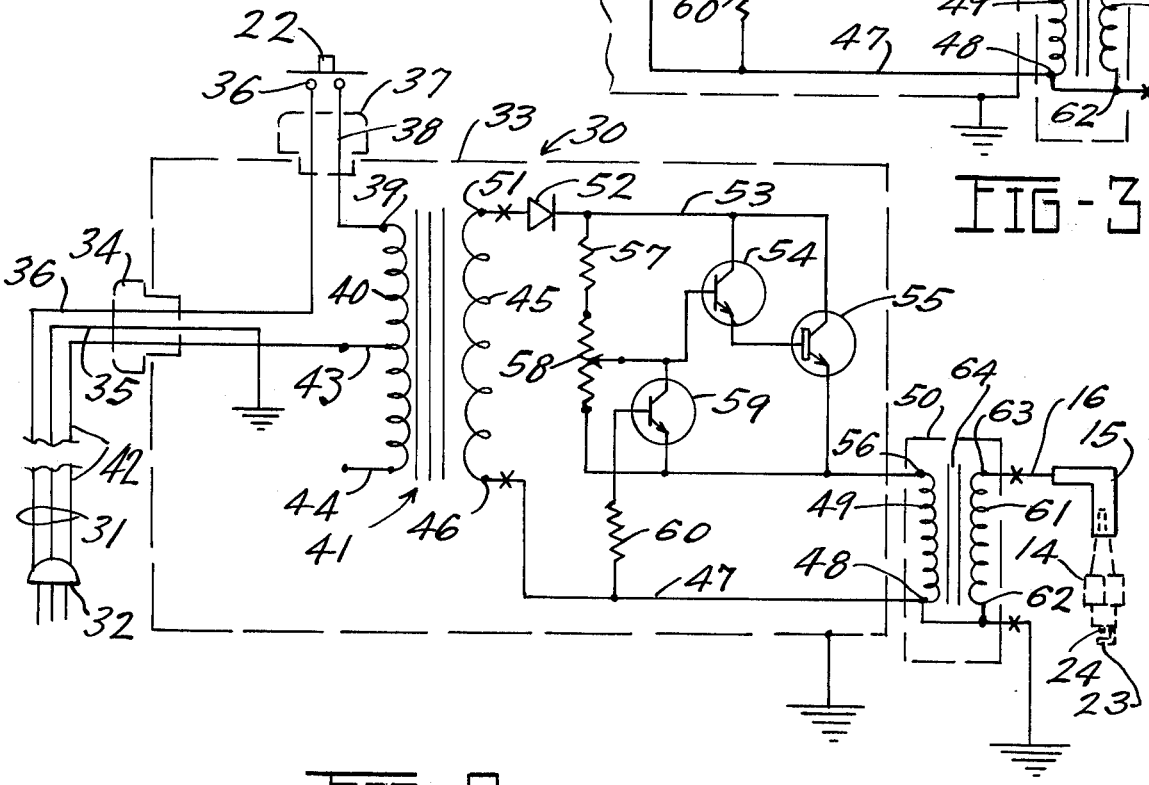
FIG. 2 is a schematic circuit diagram of an improved high voltage power supply for a spark plug test fixture constructed in accordance with the principles of the present invention.

Turning now to FIG. 2, a high voltage power supply circuit 30 is shown in accordance with the present invention. The circuit 30 is designed for operation from a standard alternating current line source. The circuit 30 is provided with a line cord 31 terminating at a plug 32 for connection to such alternating current line source, such as the 110-volt, 60-Hz. source available in some countries such as the United States and Canada or to a 220-volt, 50-Hz. line source available in still other countries. The circuit 30 is located within a grounded metal housing represented by the dashed line 33. The line cord 31 is passed through a strain relief bushing 34 mounted on the housing 33. The line cord 31 includes a safety ground wire 35 which is grounded to the metal housing 33. A second wire 36 within the line cord 31 passes through the bushing 34 and through a second strain relief bushing 37 to the momentary contact push button switch 22. The switch 22 has a second connection through a wire 38 to one end 39 of a primary winding 40 on a voltage step-down transformer 41. A third wire 42 in the line cord 31 is attached to one of two taps 43 or 44 (tap 43 shown) on the primary winding 40. When the circuit 30 is to be operated from a 110-volt, 60-Hz. power source, the wire 42 is connected to the tap 43, as shown. When the circuit 30 is to be operated in a country having 220-volt, 50-Hz. commercial power, the wire 42 is connected to the tap 44. The tap 43 or 44 on the primary winding 40 is selected to provide a predetermined voltage, such as twelve volts, across a secondary winding 45 on the step-down transformer 41. One end 46 of the secondary winding 45 is connected through a terminal 47 to a grounded end 48 of a primary winding 49 on a conventional high voltage ignition coil 50. The secondary winding 45 on the step-down transformer 41 has a second end 51 which is connected through a diode 52 to a terminal 53 for applying positive half cycle pulses of the alternating current output from the transformer 41 to the terminal 53. The terminal 53 is connected through a pair of Darlington connected transistors 54 and 55 to a second end 56 of the ignition coil primary winding 49. The collectors of both transistors 54 and 55 are connected to the terminal 53 while the emitter of the transistor 54 is connected to the base of the transistor 55 and the emitter of the transistor 55 is connected to the ignition coil primary winding end 56. A fixed resistor 57 and a potentiometer 58 also are connected in series between the terminal 53 and the ignition coil primary winding end 56. The base of the transistor 54 is connected to the variable tap on the potentiometer 58 and also is connected to the collector of a transistor 59. The transistor 59 has an emitter connected to the ignition coil primary winding end 56 and a base connected through a resistor 60 to the ignition coil primary winding end 48. Finally, the ignition coil 50 has a secondary winding 61 which is grounded at one end 62 and connected at a second end 63 through the high voltage ignition cable 16 and boot 15 to the spark plug 14.

In operation, when the switch 22 is momentarily closed, commercial line voltage is applied to the primary winding 40 of the step-down transformer 41. This results in a low voltage, such as 12 volts A.C., appearing across the ends 46 and 51 of the transformer secondary winding 45. The diode 52 rectifies this voltage to apply only positive half cycles between the terminal 53 and the terminal 47. The series resistor 57 and potentiometer 58 bias the Darlington connected transistors 54 and 55 into a conductive state to apply each rising positive half cycle to the ignition coil primary winding 49. During the rise time of the positive half cycle, current will build up in the ignition coil primary winding 49 to establish a magnetic field within an ignition coil core 64. As the positive half cycle passes its peak voltage and begins to fall towards the zero voltage crossover, the magnetic field stored in the ignition coil core 64 starts to collapse and establishes a negative voltage across the ignition coil primary winding 49. The negative voltage forward biases the base-to-emitter junction of the transistor 59, turning on transistor 59. When the transistor 59 is turned on, the base-to-emitter junction of the Darlington connected transistors 54 and 55 are shorted and the transistors 54 and 55 switch into a non-conducting state. Opening the primary circuit to the ignition coil 50 simulates the manner in which the primary circuit to an ignition coil is opened by breaker points in the ignition system for an internal combustion engine. When the primary circuit to the ignition coil 50 is opened, the rapid collapse of the magnetic field stored in the ignition coil core 64 establishes a high voltage negative pulse across the secondary winding 61 which is applied over the cable 16 to the spark plug 14. It should be noted that the transistor 59 is biased on to in turn switch off the Darlington connected transistors 54 and 55 at the same point in each positive half cycle. This provides a stable peak output voltage from the circuit 30 for accurately testing spark plugs.

The actual magnitude of the negative voltage pulse generated across the ignition coil secondary winding 61 is determined by the maximum current flowing in the ignition coil primary winding 49 prior to opening the circuit for the primary winding 49. By adjusting the setting of the potentiometer 58, conduction of the Darlington connected transistors 54 and 55 is controlled to provide a desired output voltage. The output voltage from the circuit 30 is initially calibrated by taking a new spark plug and setting the ground and center electrodes to form a predetermined size spark gap. The spark plug is then installed in the socket 12 on the test fixture 10 and the cable 16 is attached to such spark plug. Next, the valve 18 is adjusted to subject the spark gap on the plug to a predetermined pressure. The switch 22 is manually closed to energize the high voltage power supply circuit 30 and the potentiometer 58 is adjusted until the spark plug ceases to function. For example, an exemplary automotive spark plug was set to a gap of 0.045 inch and subjected to a pressure of 140 psig. The potentiometer 58 was then adjusted until the arc between the center electrode and ground electrode on the test plug was just extinguished. At this point, the output voltage from the circuit 30 was calibrated to 21 kilovolts. This voltage permits using the fixture 10 for testing aircraft type spark plugs. By changing the spark gap on the test plug to 0.035 inch, by subjecting the plug to 125 psig and by adjusting the potentiometer 58 to extinguish the spark, the resulting voltage is 17 kilovolts. Such a voltage is suitable for testing automotive type spark plugs. From the above, it will be apparent that the high voltage circuit 30 is suitable for use in spark plug test fixtures designed for testing different types of spark plugs which operate at different voltages.

Figure 3:
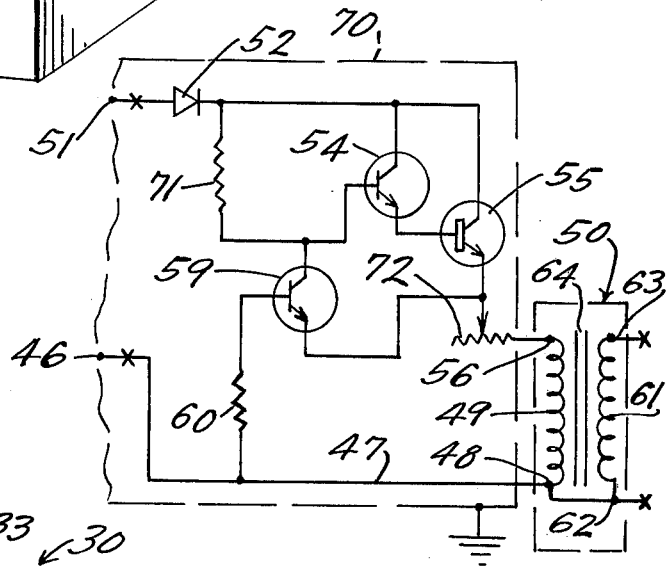
FIG. 3 is a fragmentary schematic circuit diagram of a modified embodiment of a portion of the high voltage power supply of FIG. 2.

Turning now to FIG. 3, a fragmentary portion of a modified embodiment of a high voltage power supply circuit 70 is shown. As will be seen from jointly reviewing FIGS. 2 and 3, the circuit 70 replaces a portion of the circuit 30 in FIG. 2 and is connected between the X's at the ends 46 and 51 of the step-down transformer 41 and the X's shown at the output from the ignition coil 50. Identical components between the fragmentary circuit 70 of FIG. 3 and the circuit of FIG. 2. are given identical reference numbers. The circuit 70 of FIG. 3 differs from the corresponding portions of the circuit 30 of FIG. 2 in the manner in which the peak primary current in the ignition coil 50 is controlled. In the circuit of FIG. 2, control is achieved by controlling the minimum inpedance of the Darlington connected transistors 54 and 55 while such transistors are conducting. In the fragmentary circuit 70 of FIG. 3, the peak primary current in the ignition coil 50 is controlled by controlling the resistance of the primary circuit for the ignition coil 50.

As is shown in FIG. 3, the end 51 of the step-down transformer 41 is connected through the diode 52 to the collectors of the Darlington connected transistors 54 and 55. The output from the diode 52 is also connected through a fixed resistor 71 to both the base of the transistor 54 and the collector of the transistor 59. When the transistor 59 is in a nonconducting state, the resistor 71 establishes the base bias on the transistor 54 for determining the minimum conducting impedance of the transistors 54 and 55. The output from the Darlington connected transistors 54 and 55, as taken from the emitter of the transistor 55, is connected through a variable resistor 72 to the end 56 of the ignition coil primary winding 49. The variable resistor 72 establishes the resistance of the primary circuit for the ignition coil 50 and, hence, establishes the peak current in the primary winding 49 while the transistors 54 and 55 are conducting. The emitter of the transistor 59 is connected with the emitter from the transistor 55 to the variable resistor 72. After each positive half cycle passed through the diode 52 reaches a peak voltage and begins to fall, the transistor 59 is biased into conduction at the same point in such half cycle to turn off the Darlington connected transistors 54 and 55. At this point, the primary circuit is effectively opened and a high voltage pulse appears across the secondary winding 61 of the ignition coil 50. Thus, when the circuit 70 is incorporated into the circuit 30 of FIG. 2 between the points designated by the X's, the circuit of FIG. 2 will operate in substantially the same manner with only the manner in which the peak primary current in the ignition coil 50 modified. Of course, it will be appreciated that other circuitry also may be used for adjusting the peak primary current in the ignition coil 50.

Although a specific preferred embodiment of the high voltage circuit for use in a spark plug tester has been described in addition to a specific design for a tester, it will be appreciated that various modifications and changes may be made to the circuit and the tester without departing from the spirit and the scope of the following claims. It should also be appreciated that the test circuit 30 may be incorporated into a single fixture which performs the testing function and also cleaning and reconditioning functions for spark plugs.

What we claim is:

1. In a spark plug test fixture, an improved power supply for applying high voltage pulses to a spark plug comprising, in combination, a transformer having primary and secondary windings, means for connecting said primary winding to a source of alternating current, a half wave rectifier, an electronic switch, an ignition coil having primary and secondary windings, means for connecting said ignition coil secondary winding to such spark plug, means connecting said transformer secondary winding, said rectifier, said electronic switch and said ignition coil primary winding in a closed series circuit whereby, when said electronic switch is closed, half cycles of a predetermined polarity are applied from said transformer secondary winding through said diode and said electronic switch to said ignition coil primary winding, and means for periodically opening said electronic switch to establish a high voltage across said ignition coil secondary winding for application to such spark plug.

2. An improved power supply for a spark plug test fixture, as set forth in claim 1, wherein said transformer is a voltage step-down transformer.

3. An improved power supply for a spark plug test fixture, as set forth in claim 1, wherein said electronic switch comprises a pair of Darlington connected transistors.

4. An improved power supply for a spark plug test fixture, as set forth in claim 3, and further including means for adjusting a bias voltage on said Darlington connected transistors for adjusting the peak voltage established across said ignition coil secondary winding each time said electronic switch is opened.

5. An improved power supply for a spark plug test fixture, as set forth in claim 4, wherein said means for periodically opening said electronic switch comprises means for biasing said Darlington connected transistors to a nonconductive state at a predetermined point in each half cycle of said predetermined polarity.

6. An improved power supply for a spark plug test fixture, as set forth in claim 1, and further including adjustment means for adjusting the peak voltage established across said ignition coil secondary winding.

7. An improved power supply for a spark plug test fixture, as set forth in claim 6, wherein said adjustment means includes means for limiting the peak current in said ignition coil primary winding.

8. An improved power supply for a spark plug test fixture, as set forth in claim 7, wherein said peak current limiting means comprises a variable resistor and means connecting said variable resistor in said closed series circuit.

9. An improved power supply for a spark plug test fixture, as set forth in claim 7, wherein said peak current limiting means comprises means for controlling the impedance of said electronic switch when said electronic switch is closed.

10. An improved power supply for a spark plug test fixture, as set forth in claim 1, wherein said means for periodically opening said electronic switch includes means for opening said electronic switch at a predetermined point in each half cycle of said predetermined polarity.

* * * * *